United States Patent [19]

Walker

[11] 4,397,224

[45] Aug. 9, 1983

[54] SHEET METAL ATTACHMENT SYSTEM AND METHOD FOR INSTALLATION OF MINE BRATTICES

[75] Inventor: Kenneth G. Walker, Greenville, Ky.

[73] Assignee: Hilliard-Lyons Patent Management, Inc., Louisville, Ky.

[21] Appl. No.: 234,865

[22] Filed: Feb. 13, 1981

[51] Int. Cl.[3] ..... E21F 1/14

[52] U.S. Cl. ..... 98/50; 29/432; 29/526 R; 403/388

[58] Field of Search ..... 29/432, 526 R; 98/50; 403/388, 407; 411/119, 121, 123

[56] References Cited

U.S. PATENT DOCUMENTS

| | | | |
|---|---|---|---|
| 2,937,690 | 5/1960 | Hedstrom | 403/388 X |
| 3,300,850 | 1/1967 | Steuernagel | 29/432 |
| 3,972,272 | 8/1976 | Bagby | 98/50 |

FOREIGN PATENT DOCUMENTS

| | | | |
|---|---|---|---|
| 2456242 | 12/1980 | France | 403/388 |

*Primary Examiner*—Albert J. Makay
*Assistant Examiner*—Harold Joyce

[57] ABSTRACT

A sheet metal attachment system and method for the installation of underground mine brattices of the type in which a gas impervious barrier of malleable sheet metal is retained on a peripheral framework of slotted beams. The fastening system involves pre-mounting a plurality of bolts projecting from one face of the framework as piercing pins so that the sheet metal may be initially applied by forcing it over the pins. The pierced sheet metal is then drawn against the framework by a multi-apertured washer plate and barrier mounting nut threaded onto the bolts.

1 Claim, 3 Drawing Figures

SHEET METAL ATTACHMENT SYSTEM AND METHOD FOR INSTALLATION OF MINE BRATTICES

BACKGROUND OF THE INVENTION

This invention relates to mine brattice installations and more particularly, it concerns an improved system and method for mounting a malleable sheet metal barrier on a jack post supported peripheral framework in an underground mine tunnel.

In commonly assigned U.S. Pat. No. 3,972,272, issued Aug. 3, 1967 to James Allen Bagby, there is disclosed a mine brattice structure in which a gas impervious barrier of malleable sheet metal, such as aluminum, is affixed to a yieldable peripheral framework in turn supported by shear pin retained, telescopic jack posts spaced from each other in the general plane of the brattice. An essentially air-tight seal between the sheet metal barrier and the wall surfaces defining the interior tunnel periphery in which the brattice is placed is achieved by bending, hammering or otherwise deforming the edges of the malleable sheet metal into engagement with the interior tunnel surfaces.

In the installation of such brattices, the jack posts are first placed between the mine tunnel floor and roof to be appropriately spaced across the width of the tunnel. Once the jack posts are installed, a framework of slotted beams are bolted to each other and to the jack posts so as to conform roughly with the inner periphery of the tunnel. The air impervious sheet metal barrier is then mounted to the framework and deformed into sealing engagement with the tunnel surfaces to complete the brattice installation.

Because the intended function of the brattice is to provide a barrier against air or gas flow in mine ventilating systems, the pressures to which the brattice is subjected can be substantial and require that the sheet metal be attached to the jack post supported framework securely. In light of this, threaded bolts and nuts have been preferred to achieve the needed mounting strength for the sheet metal barrier and also to minimize leakage of air or gas.

While both sides of the brattice are most generally accessible, considerable time has been required for the installation of such brattices particularly in the bolting attachment of the sheet metal barrier to the framework. Not only has this operation required two people, one on each side of the brattice being installed, but the difficulty of coordination between the two people particularly during the final stages of installation has been found tedious and time consuming.

SUMMARY OF THE PRESENT INVENTION

In accordance with the present invention, a sheet metal mounting system and method is provided by which brattices of the type referred to may be installed very effectively by one or more persons working on only one side of the brattice and in substantially less time that was required heretofore. Although the jack post supported, slotted beam framework is again employed, the sheet metal is erected by pressing it over piercing pins, pre-mounted at appropriate locations on the slotted beam framework, and then drawn tight against the framework by positive fastening devices. The piercing pins are preferably in the nature of threaded bolts projecting from one side of the framework so that once the sheet metal is pierced and temporarily supported by the bolts, it may be anchored permanently in place simply and effectively by drawing a multi-apertured washer and nut tight on the threaded bolt shank projecting through the pierced sheet metal.

A primary object of the present invention is, therefore, the provision of an improved system and method for mounting a malleable sheet metal barrier on a jack post supported framework in the installation of underground mine brattices and by which such installation is simplified and expedited. Other objects and further scope of applicability of the present invention will become apparent from the detailed description to follow taken in conjunction with the accompanying drawings in which like parts are designated by like reference numerals.

DETAILED DESCRIPTION OF THE PREFERRED EMBODIMENT

Figure 1:
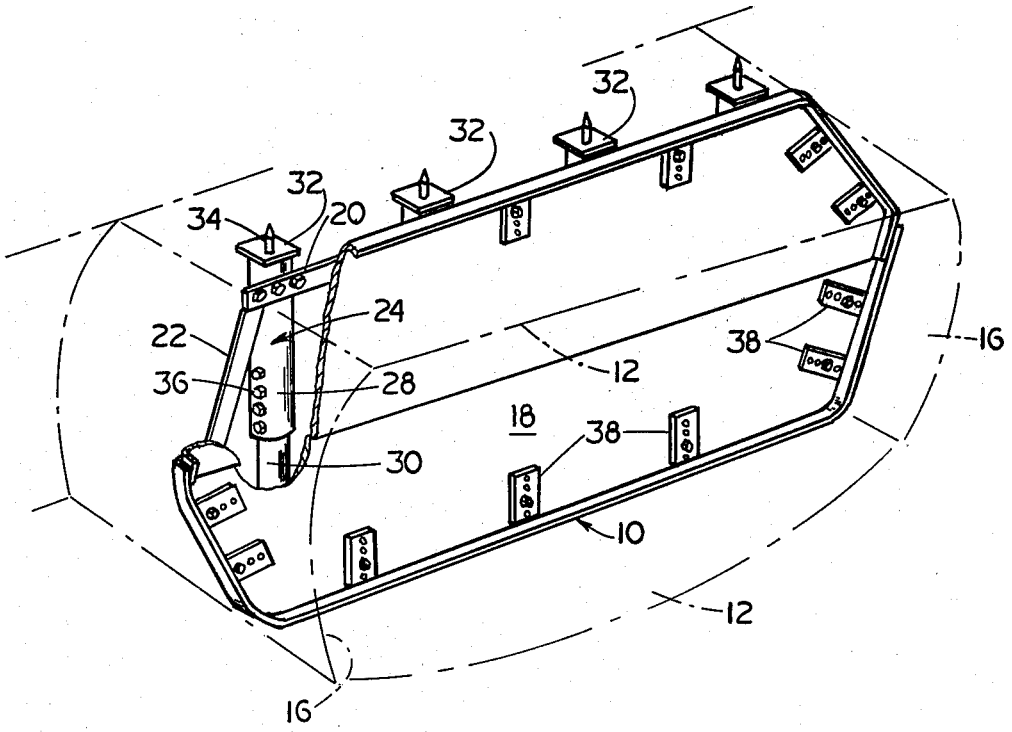
FIG. 1 is a partially cut away perspective view of a mine brattice in which the system and method of the present invention is applicable.

In FIG. 1 of the drawings, a mine brattice in which the present invention is particularly suited for use, is generally designated by the reference numeral 10 and shown in a mine tunnel represented in phantom lines to include a floor 12, a roof 14, and side edges or ribs 16. As is well known, the installed brattice functions to block the passage of air and other gases through the tunnel section in which it is placed and to this end, includes a gas impervious sheet metal barrier 18 supported from a peripheral framework of slotted, plate-like beams 20 and 22 bolted or otherwise yieldably connected to each other for relative sliding and pivotal movement under forces resulting from dimensional changes in the mine tunnel. The framework of beams 20 and 22 is supported by suitable means such as U-bolts to a plurality of vertical jack posts 24 spaced horizontally from each other in the general plane of the brattice 10.

It will be appreciated from the illustration in FIG. 1 and from the full disclosure of the aforementioned U.S. Pat. No. 3,972,272 that the brattice 10 is installed by first placing the jack posts 24 between the floor 12 and roof 14 of the mine tunnel, securing the framework of slotted beams 20 and 22 to the jack posts 24 in a manner to generally complement the interior peripheral configuration of the mine tunnel, and then by placement of the sheet metal barrier 18 to the jack supported framework. A highly effective seal may be provided between the sheet metal barrier 18 and the interior periphery of the mine tunnel by bending or otherwise deforming the edges of the sheet metal into sealing engagement with the interior tunnel surfaces. The installation of the sheet metal barrier 18 in this manner is facilitated by the malleable characteristics of such metals as aluminum and further by the use of multi-apertured washer plates 26 tending to retain the edges of the sheet metal barrier in place.

Each of the jack posts 24 are formed of telescopically interconnected upper and lower sections 28 and 30, respectively, which in practice may be appropriately sized sections of conventional pipe. The top of the upper pipe section 28 and the bottom of the lower pipe section 30 are fitted with anchorage plates 32 from which a pointed dowel-like pin 34 may project to assure a firm anchorage in the floor and roof of the tunnel in which the brattice is to be installed.

The jack posts 24 are placed using a hydraulic or mechanical lifting jack (not shown) which operates to lift the upper section 28 relative to the lower section and serves to compress the upper and lower sections 28 and 30 firmly against the roof 14 and floor 12, respectively. The extended relationship of the upper and lower sections 28 and 30 is then maintained by a system of shear pins 36.

As described in the aforementioned U.S. Pat. No. 3,972,272, the sheet metal barrier 18 may be formed in two or more sheet sections and is preferably bolted to the framework of slotted beams 20 and 22 using multi-apertured washer plates 38 at least about the peripheral edges of the brattice. By selection of the appropriate aperture in each washer plate 38, the portion of the sheet metal outside the framework of the beams 20 and 22 is supported by projection of the washer plate to the inner surface of the tunnel.

Figure 2:
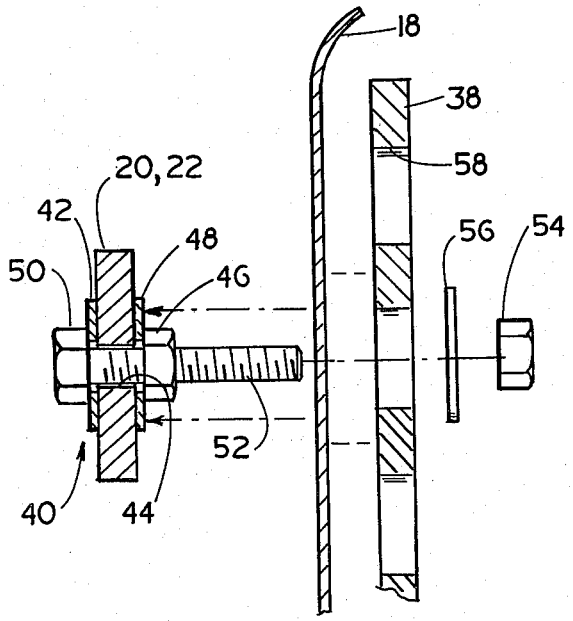
FIG. 2 is an exploded fragmentary cross-sectional view illustrating the various components of the mining system of the present invention.

In accordance with the present invention, prior to installing the sheet metal barrier 18, a plurality of threaded bolts 40 are first mounted on the slotted beams 20 and 22 is selected positions by inserting each bolt 40 through a head washer 42, the slot 44 of the beams 20 or 22, and fixing it in place with a bolt mounting nut 46 drawn against a nut washer 48 and the side of the beam opposite the bolt head 50. The threaded shank 52 of each bolt so fixed in place projects from one side of the framework of beams 20 and 22 as a piercing pin in the manner shown in FIGS. 2 and 3 of the drawings. Also, it is to be noted that the bolt mounting nut 46 defines a stepped enlargement at the base of each projecting bolt shank 52 or piercing pin.

With the bolts 40 fixed in place and projecting as piercing pins from a common side of the slotted beams 20 and 22, the sheet metal barrier 18 is installed by pressing the sheet metal against the projecting ends of the bolt shanks 52 sufficiently so that the bolt shanks pierce the sheet metal. This piercing application of the sheet metal to the bolts shanks may be effected in practice using a conventional wrench socket and hammer or by using one of the mounting plates 38 and a hammer. In this respect it is to be noted that the sheet metal used for the barrier 18 is untempered aluminum having a thickness of from 0.17 to 0.19 inches. The bolts 40 are preferably conventional one quarter inch machine bolts having a threaded shank of between 1.5 and 2.5 inches in length. In light of the shank diameter of the bolts and the guage of non-tempered aluminum used for the barrier 18, it will be appreciated that the pressing force needed for the bolts to pierce the aluminum is readily developed using such techniques.

Figure 3:
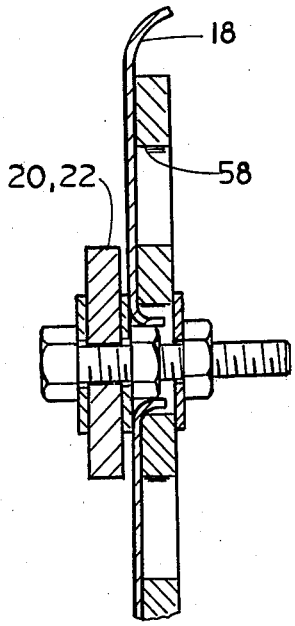
FIG. 3 is a similar partial cross-section with the system components permanently in place.

After being pierced by the bolt shank 52 in the aforementioned manner, the washer plate 38 is applied and drawn against the sheet metal 18 by a barrier retaining nut 54 and washer 56. The final position of the various mounting components as well as the sheet metal 18 is as illustrated in FIG. 3 of the drawings. From the illustration in FIG. 3, it will be noted that the apertures 58 in the mounting plate 38 are in a size larger than the outside diameter of the bolt mounting nuts 46 by an amount such that during the final threading of the barrier retaining nuts 54, the sheet metal 18 is forced against the bolt retaining nut 46 deforming the pierced portion of the sheet metal 18 surrounding the bolt shank 52 into the mounting plate aperture 58 wherein it is seized between the outside of the bolt mounting nut 46 and the interior of the mounting plate aperture 58. In this way, a very firm, gas-tight mounting of the sheet metal 18 is accomplished.

From the foregoing it will be appreciated that the sheet metal mounting system and method of the present invention enables complete placement of the brattice by one person and without requiring access to both sides of the brattice at least during the final stage of installation. This latter feature is particularly important in underground mine environments where access to both sides of an installed brattice is often not conveniently available. Prior to placement of the sheet metal barrier 18, of course, access may be had to opposite sides of the jack posts 24 and of the framework of beams 20 and 22 supported thereon due to the open character of the framework at that stage of brattice installation.

In light of the foregoing, it may be seen that as a result of the present invention, a highly improved system and method for mounting the sheet metal barrier of brattices of the type described and by which the stated objective among others are completely fulfilled. It is also contemplated that modifications and/or changes may be made in the embodiment of the invention described and illustrated herein. Accordingly, it is expressly intended that the foregoing description and accompanying drawings are illustrative only, not limiting, and that the true spirit and scope of the present invention will be determined by reference to the appended claims.

I claim:

1. In the installation of a mine brattice having a gas impervious barrier of malleable sheet metal adapted to be deformed into sealing contact about the peripheral inner surfaces of a mine tunnel, and means to support said barrier including a peripheral framework of slotted beams, a method of securing said sheet metal barrier to said framework of slotted beams comprising the steps of:

premounting a plurality of threaded bolts to said slotted beams by drawing bolt mounting nuts along the length of the bolts and against said slotted beams so that the threaded shanks of the bolts project from one side of the framework;

placing the sheet metal adjacent the side of the framework of slotted beams from which the threaded shanks of the bolts project;

forcing the sheet metal over the projecting bolt shanks causing the sheet metal to be pierced by each bolt shank;

placing an apertured washer plate over the bolt shanks projecting through the pierced sheet; and, threading a barrier retaining nut on each of the bolt shanks projecting through said washer plates thereby drawing said washer plate against the sheet and the slotted beams forcing the sheet against the bolt mounting nuts causing the sheet to be deformed by the bolt mounting nuts into the washer plate apertures and seized between said bolt mounting nuts and the periphery of the washer plate apertures.

* * * * *